US005117772A

United States Patent [19]

Horton et al.

[11] Patent Number: 5,117,772

[45] Date of Patent: Jun. 2, 1992

[54] PUNCH EMBROIDERING TOOL

[75] Inventors: Lana M. Horton, Anaheim; Donald L. McGrath, Jr., Glendora, both of Calif.

[73] Assignee: The Punch Connection, Anaheim, Calif.

[21] Appl. No.: 617,151

[22] Filed: Nov. 23, 1990

[51] Int. Cl.[5] ..... D05C 15/06

[52] U.S. Cl. ..... 112/80.05

[58] Field of Search ..... 112/80.05, 80.03, 80.16, 112/222; 223/104, 102; 66/116, 117, 118

[56] References Cited

U.S. PATENT DOCUMENTS

| | | | |
|---|---|---|---|
| 1,469,906 | 10/1923 | Hansen | 112/80.05 |
| 2,610,598 | 9/1952 | Midas | 112/80.05 |
| 4,273,058 | 6/1981 | Martushev | 112/80.05 |
| 4,765,264 | 8/1988 | Bruton | 112/80.05 |
| 4,886,003 | 12/1989 | Walker | 112/80.03 |

FOREIGN PATENT DOCUMENTS

| | | | |
|---|---|---|---|
| 0009275 | 9/1932 | Austria | 112/80.05 |

*Primary Examiner*—Peter Nerbun

*Attorney, Agent, or Firm*—William L. Chapin

[57] ABSTRACT

A punch embroidering tool for inserting yarn through fabric and forming loops of yarn includes a hollow needle of the type used in hypodermic syringes, modified by punching a transverse hole through the needle adjacent to the point of the needle, for receiving the end of a yarn strand. The base of the needle is press-fitted into a hollow cylindrical needle support tube having a longitudinally disposed bore communicating with the needle bore. The outer cylindrical wall surface of the needle support tube is provided with a plurality of longitudinally spaced apart, annular grooves, and fits longitudinally slidably with a hollow cylindrical housing. A bushing having one or more pairs of slots extending longitudinally forward from its rear transverse annular end wall fits slidably over the grooved portion of the needle support tube, coaxially within the housing. A screw cap tightenable on the rear end of the housing radially compresses portions of the bushing between the slots into a selected annular groove, locking the needle at a selected longitudinal extension from the housing.

9 Claims, 2 Drawing Sheets

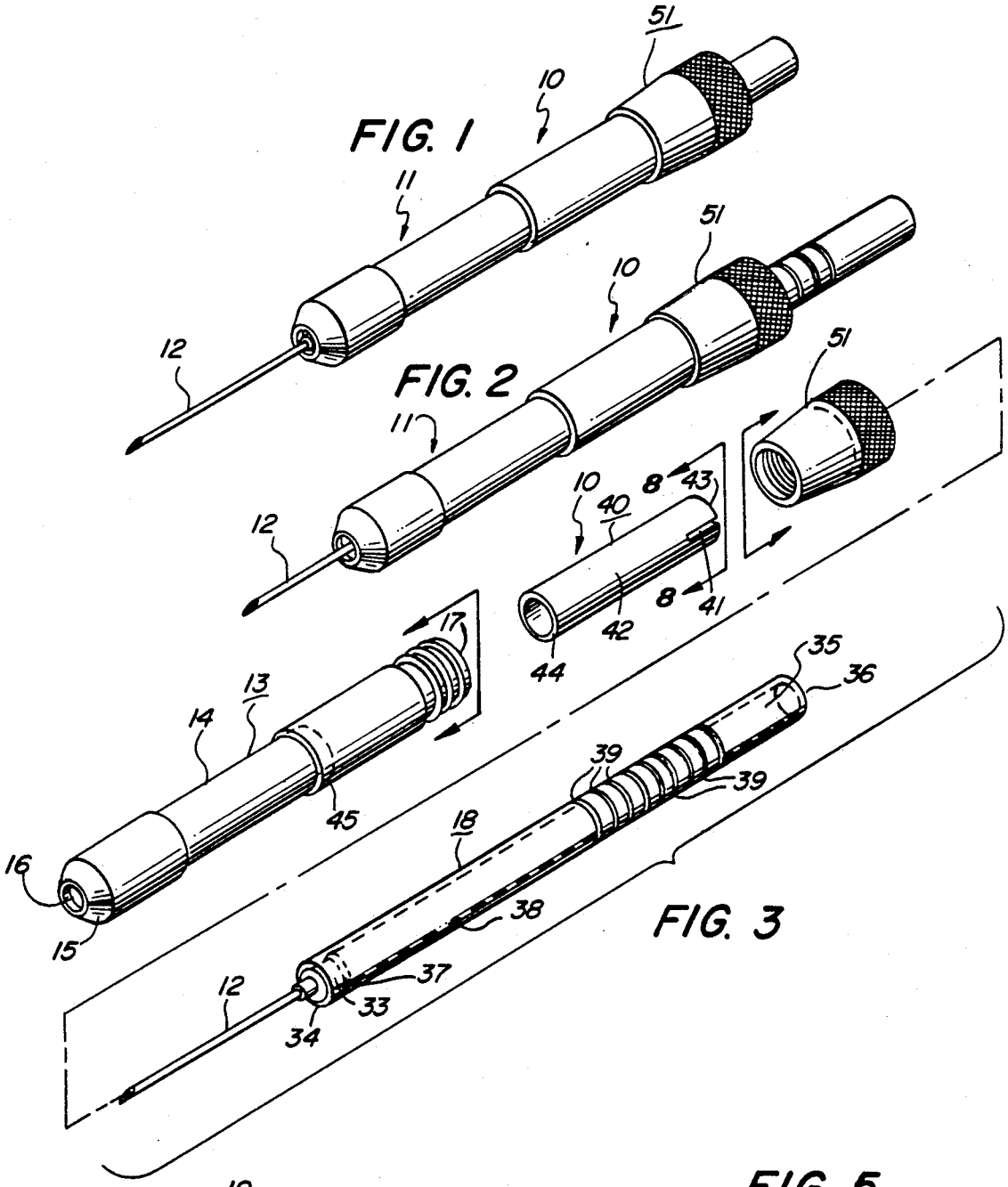
FIG. 1
FIG. 2
FIG. 3
10
11
12
13
14
15
16
17
18
33
34
35
36
37
38
39
40
41
42
43
44
45
51
8
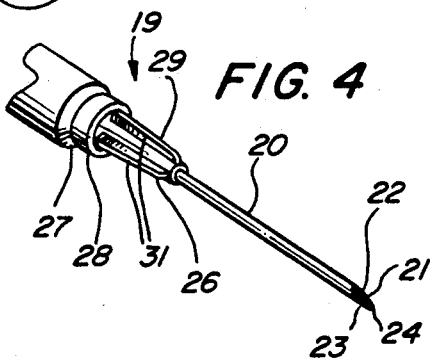
FIG. 4
19
20
21
22
23
24
26
27
28
29
31
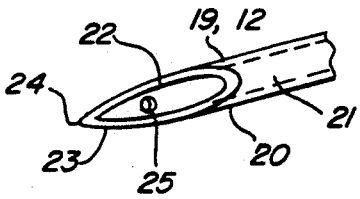
FIG. 5
19, 12
20
21
22
23
24
25

PUNCH EMBROIDERING TOOL

FIELD OF THE INVENTION

This invention relates to implements for use in the embroidery of fabrics. More particularly, the invention relates to a punch embroidering tool which facilitates the embroidering of woven fabrics.

DESCRIPTION OF BACKGROUND ART

The embroidering process has been used to decorate fabrics since the time of the ancient Egyptians and Greeks. In its simplest form, embroidering consists of inserting a thread, which may be selected from a wide variety of colors, through the eye of a needle, inserting the needle through the fabric, drawing the needle all the way through the fabric, re-inserting the needle at a different location on the rear of the fabric, and drawing the needle and attached thread through the front surface of the fabric, to complete one cycle or "stitch." In this manner, colorful decorative patterns of any type may be embroidered on the surface of a piece of fabric, producing an attractive tapestry-like effect.

In addition to the embroidering process described above, another popular embroidering process called punch embroidery exists. Punch needle embroidery, sometimes called loop embroidery, is used to embroider thick or strong fabrics, and when it is desired to use heavier threads. In punch embroidery, a heavy needle having a hollow bore and an eye very close to the sharpened tip of the needle, is inserted through a first. or rear side of a fabric sufficiently far for a thread, previously inserted through the rear end of the bore and out through the eye, to be secured behind a second, or front side of the fabric. The needle is then withdrawn, leaving a loop of thread on the front side of the fabric. The needle is then moved to a new insertion location and re-inserted into the rear side of the fabric at that location.

Punch needle embroidery has been traced back to the 16th century, where it was discovered that punch embroidery work was done in French convents and in the Ukraine to make church vestments. The first punch needles were made from hollow bird wing bones, and later of rolled tin. These needles were threaded by sucking the thread through the needle bore, and inserting an end of the thread through the eye.

Recently, punch embroidering tools have been manufactured which use a hollow needle of the type used in hypodermic syringes for administering intravenous injections or drawing blood samples. Hypodermic needles used for this purpose are modified by having a small transversely disposed thread-hole drilled through the diagonally cut end of the needle, just rearward of the sharpened point of the needle.

Hypodermic needles modified as described above have proven quite satisfactory in punch embroidering applications. A problem has existed, however, in providing a handle or holder for modified hypodermic needles which could safely contain the needle when the tool is not in use. Also, it would be desirable to have an embroidering tool in which extension distance of the needle from the tool could be controlled, thereby controlling the length of thread loops produced using the tool.

An embroidering tool employing a modified hypodermic needle which is retractable within the handle of the tool, and lockable at an adjustable extension distance from the handle was disclosed in Walker, U.S. Pat. No. 4,886,003, Dec. 12, 1989. Embroidering Tool.

The present invention was conceived to provide an improved embroidering tool of simpler design.

OBJECTS OF THE INVENTION

An object of the present invention is to provide a punch embroidering tool having a needle which is retractable to a safe position inside the body of the tool when the tool is not in use.

Another object of the invention is to provide a punch embroidering tool having an embroidering needle which is extendible an adjustable distance from the body of the tool, and lockable at the desired extension distance.

Another object of the invention is to provide a punch embroidering tool constructed of a small number of components.

Another object of the invention is to provide a punch embroidering tool which may be manufactured using a small number of fabrication steps.

Various other objects and advantages of the present invention, and its most novel features, will become apparent to those skilled in the art by perusing the accompanying specifications, drawings and claims.

It is to be understood that although the invention disclosed herein is fully capable of achieving the objects and providing the advantages described, the characteristics of the invention described herein are merely illustrative of the preferred embodiment. Accordingly, we do not intend that the scope of our exclusive rights and privileges in the invention be limited to details of the embodiments described. We do intend that equivalents, adaptations and modifications of the invention reasonably inferable from the description contained herein be included within the scope of the invention as defined by the appended claims.

SUMMARY OF THE INVENTION

Briefly stated, the present invention comprehends an improved tool useful for punch embroidering of woven fabrics.

The punch embroidering tool according to the present invention includes a hollow needle having a sharpened point. The preferred embodiment of the punch embroidering tool according to the present invention employs a modified needle of the type used with hypodermic syringes. Such needles have a sharpened point, and a diagonally disposed flat extending rearward a short distance from the sharpened point of the needle, the flat slicing into the hollow coaxial bore provided through the needle. As used in the present invention, the hypodermic-type needle is modified by the provision of a small transversely disposed thread-hole through the cylindrical wall of the needle, just rearward of the sharpened point and opposite the diagonally cut wall.

The base of the needle used in the punch embroidering tool according to the present invention is preferably secured within a short coaxial hub section, and the latter is press-fitted into one end of a hollow needle support tube. The tool includes a tubular handle or housing, within which the needle support tube is securable at an adjustable longitudinal position within the housing.

The novel means for securing the needle support tube at an adjustable longitudinal position within the housing of the tool allows the needle point to be positioned safely within the housing, when the tool is not in use, or at an adjustable extension distance from the housing, when the tool is in use. The needle-securing means includes a plurality of longitudinally spaced apart, annular grooves in the outer wall surface of the needle support tube.

A cylindrical plastic bushing having a plurality of slots extending longitudinally from an end annular wall surface of the cylinder, through the cylindrical wall surface thereof, comprises another element of the needle-securing means. The bushing is coaxially and slidably positioned over the grooved portion of the needle support tube.

The needle securing means also includes means for radially compressing the end portions, or legs, of the flexible bushing between the slots onto a selected annular groove. The inner radial edges of the transverse, semi-annular end wall of the bushing legs are thus depressed into a groove, securing the needle support tube in a fixed longitudinal relationship to the bushing. Means for holding the bushing at a fixed longitudinal position within the housing are also provided, thus securing the needle point at an adjustable, locked longitudinal position relative to the housing. In the preferred embodiment, the bushing compression means cooperates with an annular flange within the housing to secure the bushing at a fixed longitudinal position within the housing.

BRIEF DESCRIPTION OF THE DRAWINGS

FIG. 1 is a perspective view of one embodiment of a punch embroidering tool according to the present invention.

FIG. 2 is a view similar to FIG. 1, but showing the needle of the tool retracted.

FIG. 3 is an exploded view of the tool of FIG. 1.

FIG. 4 is an enlarged view of a needle for a hypodermic syringe, of a type used in the tool of FIG. 1.

FIG. 5 is a magnified view of a front end portion of the needle shown in FIG. 4.

DETAILED DESCRIPTION OF THE INVENTION

Figure 6:
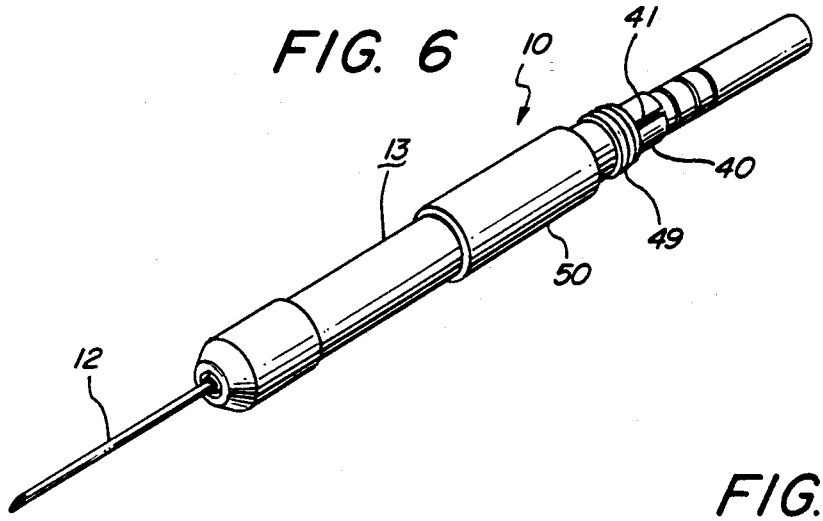
FIG. 6 is a fragmentary view showing some of the components of the tool of FIG. 3 assembled together.

FIGS. 1 through 9 illustrate a novel punch embroidering tool constructed in accordance with concepts of the present invention.

As shown in FIG. 1, the embroidering tool 10 to the present invention has exteriorly the shape of an elongated, generally cylindrical, circularly symmetric body, having an elongated needle 12 coaxial with the body extending forward from the body, along the longitudinal center line thereof.

FIG. 1 shows tool 10 with needle 12 in an operable position, while FIG. 2 shows the needle retracted within body 11, for safe storage and/or transit.

As may be seen best by referring to FIG. 3, tool 10 includes an elongated hollow, cylindrical housing 13. Housing 13 is made of a rigid, durable material, such as aluminum or a structural plastic. If housing 13 is made of aluminum or metal, the wall thickness of longitudinal portion 14 of the housing is preferably small to reduce both the weight and cost of tool 10. Housing 13 has at its front transverse end an annular end wall 15 having a central coaxial bore 16 which is smaller in diameter than the diameter of a central coaxial bore 17 which extends through the interior of housing 13 from the rear transverse wall of the housing.

As shown in FIG. 3, front annular end wall 15 may be tapered, thus making the end wall frusto-conically shaped. Preferably, end wall 15 is formed integrally with the other portions of housing. Thus, housing 13 is preferably formed in one piece by machining an aluminum blank or pre-form, casting, injection molding, or by a similar unitary fabrication process which requires a minimum number of secondary manufacturing steps.

Referring again to FIG. 3, punch embroidering tool 10 includes an elongated, cylindrically shaped hollow needle support tube 18. A needle 12 of the type used in hypodermic syringes, but having certain structural modifications, protrudes forward from needle support tube 18, the support tube and needle having a common longitudinal center line FIG. 4 shows an unmodified hypodermic syringe needle 19. As shown in FIG. 4, syringe needle 19 has an elongated hollow steel tube 20 or cannula having a central bore 21 which extends through the entire length of the needle. Tube 20 of needle 19 has a diagonally cut front face 22 extending rearward from a sharpened point 23 to form a tip 24.

As shown in FIG. 5, tip 24 of needle 19 is modified small hole 25 transversely through the cylindrical wall of tube 20 Hole 25 is located longitudinally rearward a short distance from point 23 of tip 24, diametrically opposite diagonally cut front face 22.

Referring again to FIG. 4, syringe needle 19 has an enlarged diameter coaxial hub 26. Typically, hub 26 has a flat annular base 27, a rear cylindrical boss section 28, and a smaller diameter front cylindrical boss section 29. As shown in FIG. 4, hub 26 of syringe needle 19 has an enlarged diameter annular ring 30 adjacent base 27. Hub 26 may also be provided with longitudinally disposed, raised ribs 31. Also, hub 26 has a bore 32 coaxially aligned with and in communication with bore 21 of cannula 20.

In a preferred embodiment of tool 10 according to the present invention, a syringe needle 19, modified by punching a transverse hole 25 in tip 24, is further modified to adapt the syringe needle for attachment to needle support tube 18. The additional modification consists of machining off annular base ring 30 from rear cylindrical base section 28 of hub 26 to make the base section of constant diameter. Longitudinal ribs 31 may also be partially or completely milled off, if desired. Thus modified, hub 26 of needle 19 is inserted into a coaxial bore 33 extending inwards from the front transverse face 34 of needle support tube 18. Bore 33 of needle support tube 18 is of slightly smaller diameter than the outer diameter of hub 26, the difference between the two diameters being of the proper amount to allow hub 26 to be securely press-fitted into bore 33.

Needle support tube 18 also has a rear coaxial bore 35 extending forward from rear transverse face 36 of the needle support tube. Rear bore 35 of needle support tube 18 communicates with front bore 33, which in turn communicates with bores 32 and 21 of modified needle 12, thus allowing a thread to pass through the entire length of the needle support tube and needle. Preferably, rear bore 35 of needle support tube 18 is smaller in diameter than front bore 33. This arrangement results in the formation of an annular flange 37 within tube 18 inward of front transverse face 34 of the tube. Flange 37 may, if desired, function as a seating plane on which annular base 27 of hub 26 may "bottom out" longitudinally when the hub is press-fitted into entrance bore 33 of the tube.

As shown in FIG. 3, the outer cylindrical wall surface 38 of needle support tube 18 is provided with a plurality of shallow annular grooves 39 longitudinally spaced apart from one another. The purpose of these grooves 39 will be described shortly.

Figure 7:
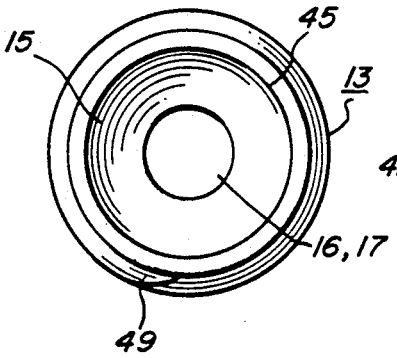
FIG. 7 is a rear end elevation view of a housing comprising part of the tool of FIGS. 1 and 2.

FIG. 6 shows certain components of tool 10 shown in FIG. 3 assembled together. As shown in FIG. 6, needle support tube 18 is inserted into rear central coaxial bore 17 of housing 13 with needle 12 protruding forward from the housing through bore 16 in front annular wall 15 of the housing. Needle support tube 18 may then be pushed longitudinally forward within bore 17 of housing 13 until front transverse face 34 of the needle support tube contacts the inner surface of front annular end wall 15 of housing 13, as shown in FIG. 7.

Figure 8:
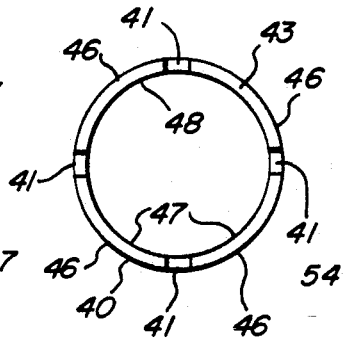
FIG. 8 is a rear end elevation view of a bushing comprising part of the tool of FIGS. 1 and 2.

As shown in FIGS. 3, 6 and 8, tool 10 also includes a split bushing 40. Bushing 40 is fabricated from thin-wall tubing made of a flexible material having a slight memory, such as butyrate, nylon, Delrin or Teflon. The inner diameter of bushing 40 is of the proper size to fit relatively snugly over needle support tube 18, while allowing the bushing to slide relatively easily over the tube.

As may be seen best by referring to FIGS. 3 and 6, split bushing 40 is provided with at least one pair of diametrically opposed, rectangular slots 41 cut through the cylindrical wall surface 42 of the bushing, and extending longitudinally forward from rear transverse annular face 43 of the bushing. Preferably, as shown in FIG. 8, bushing 40 is provided with four slots 41 spaced circumferentially apart at 90-degree intervals.

As shown in FIG. 6, bushing 40 is slidable longitudinally forward over needle support tube 18 and into bore 17 of housing 13 until the front transverse face 44 of the bushing abuts an annular wall flange 45 formed within the housing. Flange 45 may be best seen by referring to FIG. 7. Preferably, wall flange 45 is frusto-conically tapered, having a front inner diameter smaller than its rear diameter. This arrangement results in a radially inwardly directed compressive force being exerted on the front end portion of bushing 40 and needle support tube 18 when the bushing is forced forward against flange 45. Now, as shown in FIGS. 3, 6 and 8, a longitudinally disposed, rectangular plan-view leg 46 is formed in the cylindrical wall surface 42 of bushing 40, between each pair of slots 41. As shown in FIG. 8, each leg 46 has a curved edge 47 formed at the junction of the inner cylindrical wall surface 48 and rear transverse face 43 of bushing 40. When needle support tube 18 is slid longitudinally forward within bushing 40, edges 47 tend to spring downwards into an annular groove 39, when the edges are longitudinally aligned with a groove. Thus, legs 46 of bushing 40 and grooves 39 of needle support tube 18 cooperate to provide detents for different longitudinal extensions of needle 12 from housing 13. Detent action may, if desired, be enhanced by chamfering rear annular wall surface 43 of bushing 40, thus making that surface intersect the cylindrical wall surface of the bushing at an acute angle. Needle support tube 18 is lockable at a selected detent position in a manner which will now be described.

Figure 9:
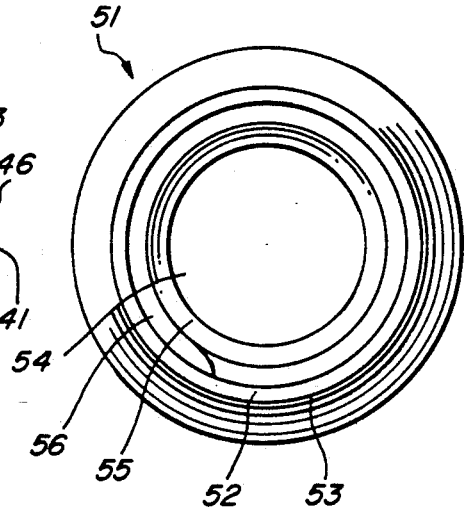
FIG. 9 is a front end elevation view of a locking cap forming part of the tool of FIGS. 1 and 2.

Referring to FIGS. 3, 6 and 9, it is seen that the rear portion of housing 13 is provided with external helical threads 49 in the outer cylindrical wall surface 50 of the housing. Tool 10 also includes a concave, cylindrically-shaped locking cap 51 having internal helical threads 52 in its inner cylindrical wall surface 53. Threads 52 of locking cap 51 are complementary to threads 49 of housing 13, permitting the locking cap to be threadingly secured to the rear end of the housing.

As may be seen best by referring to FIG. 9, a central coaxial bore 54 is provided through rear transverse end wall 55 of locking cap 55, to allow needle support tube 18 to slide through the bore. Locking cap 51 is also provided with a frusto-conically shaped, annular flange 56 joining the inner cylindrical wall surface 53 of the cap to the inner surface of rear transverse end wall of the cap. Now, when locking cap 51 is screwed down on housing 13, annular flange 56 of the locking cap exerts a radially inwardly directed force component on the outer longitudinal surface of legs 46. This force pushes edges 47 of legs 46 into an adjacent groove 39, firmly locking needle support tube 18 and attached needle 12 at a selected longitudinal position.

An important advantage of tool 10 over prior art punch embroidering tools is its capability of allowing the longitudinal extension of tip 24 of needle 12 to be adjusted without turning the needle, by longitudinal movement only. With prior art tools, if it is desired to alter thread or yarn loop length while the needle is inserted into a fabric workpiece, the needle must be rotated relative to the fabric, causing the yarn to tangle.

Figure 10:
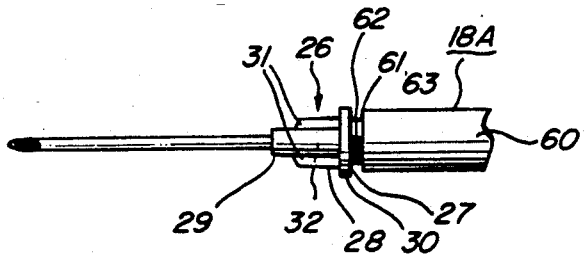
FIG. 10 is a perspective view of an alternate embodiment of a needle support tube forming part of the tool of FIGS. 1 and 2.

FIG. 10 illustrates a modification of the needle support tube 18 used in the pencil embroidering tool 10.

Modified needle support tube 18A, as shown in FIG. 10, has a cylindrical main body portion 60. A short cylindrical boss section 61 of smaller diameter than body portion 60 protrudes forward from the body portion 60, coaxial therewith. Boss section 61 is provided with external helical threads 62. Threads 62 are complementary to internal helical threads 63 provided inside hub 26, on the inner wall surface adjacent bore 32 of the hub. Thus constructed, modified needle 19A may be attached to needle support tube 18A by screwing threaded boss 61 of the needle support tube into hub 26 of the needle.

What is claimed is:

1. A punch embroidering tool for inserting threads through fabric comprising:

a. an elongated hollow needle having a sharpened front point and a bore disposed through said point to the rear transverse wall of said needle.

b. an elongated hollow needle support tube having a front transverse end wall, rear transverse end wall, a bore spanning the longitudinal distance between said front and rear transverse end walls, said base of said needle being fastened to said needle support tube near said front transverse end wall of said needle support tube, said bore of said needle being in communication with said bore of said needle support tube, the outer longitudinal wall surface of said needle support tube having formed therein a plurality of longitudinally spaced apart indentation.

c. a cylindrical bushing longitudinally slidably fitting over the indented portion of said needle support tube, said bushing having formed therein a pair of circumferentially spaced apart, longitudinally disposed slots extending longitudinally inward from an annular end wall of said bushing, said slots forming therebetween a longitudinally disposed leg movable into locking engagement with a selected one of said indentations, and an elongated housing for supporting said needle support tube and said bushing, said housing having a central coaxial bore adapted to slidably receive said bushing and said needle support tube, said housing having formed in the inner cylindrical wall surface thereof an annular wall flange of smaller inner diameter than the outer diameter of said bushing, for limiting forward motion of said bushing within said housing, and means for exerting a longitudinally forward direction force on the rear annular wall surface of said bushing, whereby said point of said needle may be fixed at an adjustable protrusion distance from said housing.

2. The tool of claim 1 wherein said indentations are further defined as being annular grooves.

3. The tool of claim 1 wherein said means for exerting a longitudinally forward directed force on the rear annular wall surface of said bushing comprises a concave locking cap having a central coaxial aperture for slidably receiving said needle support tube, said locking cap having means for securing the cap to the rear end of the housing, and said locking cap having an internal annular flange of smaller inner diameter than the outer diameter of said bushing.

4. The tool of claim 3 wherein said means for securing said locking cap to the rear end of said housing comprises in combination an external helical thread formed in the outer cylindrical wall surface of said housing, said external helical thread extending longitudinally forward from said rear transverse wall of said housing, and an internal helical thread complementary to said external helical thread formed in the inner cylindrical wall surface of said locking cap, said external helical thread extending longitudinally rearward from the front annular wall surface of said locking cap.

5. The tool of claim 4 wherein said slots comprising said pair of slots are diametrically opposed.

6. The tool of claim 5 wherein said bushing further comprises an additional pair of slots spaced at ninety degree intervals from said first pair of slots.

7. A punch embroidering tool for inserting threads through fabric comprising:

a. an elongated hollow hypodermic needle having a sharpened point and a bore disposed longitudinally through said needle from said point to the rear transverse wall of said needle, b. an elongated hollow cylindrical needle support tube having a front transverse end wall, a rear transverse end wall, a bore spanning the longitudinal distance between said front and rear transverse end walls, said rear transverse wall of said needle being fastened to said needle support tube, near said front transverse end wall of said needle support tube, said bore of said needle being longitudinally aligned with an in communication with said bore of said needle support tube, said needle support tube having formed in its out cylindrical wall surface a plurality of longitudinally spaced apart, annular groove, c. an elongated hollow cylindrical housing for supporting said needle support tube, said housing a central coaxial bore adapted to slidably receive said needle support tube, a front portion of said housing having formed within the inner cylindrical wall surface thereof an annular flange.

d. a hollow cylindrical bushing having a pair of slots extending longitudinally inwards from a transverse annular end wall of said housing, forming a radially and elastically movable leg between said slots, said bushing being slidably positioned coaxially over said needle support tube and within said housing, said bushing having a larger outer diameter than the inner diameter of said flange, whereby forward motion of said bushing within said housing is limited, and, e. means lockable at a fixed longitudinal position relative to said housing for depressing said leg of said bushing into a selected annular groove of said needle support tube, thereby securing said needle support tube and said needle at a fixed longitudinal position relative to said housing, said means for depressing said leg of said bushing to a selected annular groove of said needle support tube comprising a concave locking cap having a central coaxial aperture adapting said cap to be slid coaxially over said needle support tube, said cap having a tapered annular wall surface adapted to exert a radially inwardly directed force on said leg when said cap is forced longitudinally forward against said transverse wall surface of said bushing.

8. The tool of claim 7 wherein said flange within said housing is tapered, having a rear inner diameter larger than its front inner diameter, the tapered annular wall surface thereby exerting a radially inwardly directed compressive force to the front portion of said bushing and on said needle support tube when said bushing is forced forward against said flange.

9. The tool of claim 7 wherein said housing and said locking cap are provided with complementary screw threads, thus adapting said locking cap and said housing to being screwed together.

* * * * *